US010808194B2

(12) United States Patent
Abdallah et al.

(10) Patent No.: US 10,808,194 B2
(45) Date of Patent: Oct. 20, 2020

(54) FUEL HIGH TEMPERATURE ANTIOXIDANT ADDITIVE

(71) Applicant: ExxonMobil Research and Engineering Company, Annandale, NJ (US)

(72) Inventors: David J. Abdallah, Moorestown, NJ (US); Zsolt Lengyel, Newtown, PA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 16/694,044

(22) Filed: Nov. 25, 2019

(65) Prior Publication Data

US 2020/0181515 A1 Jun. 11, 2020

Related U.S. Application Data

(60) Provisional application No. 62/776,496, filed on Dec. 7, 2018.

(51) Int. Cl.
*C10L 1/23* (2006.01)
*C10L 1/232* (2006.01)

(52) U.S. Cl.
CPC ..... *C10L 1/232* (2013.01)

(58) Field of Classification Search
CPC ..... C10L 1/1232; C10L 2200/0407; C10L 2200/0423; C10L 2200/043; C10L 2200/0438; C10L 2270/023; C10L 2270/026; C10L 2270/04
See application file for complete search history.

(56) References Cited

U.S. PATENT DOCUMENTS 3,639,110 A * 2/1972 Larsen ..... C10L 1/2658 44/379
4,670,131 A 6/1987 Ferrell
6,210,452 B1 4/2001 Su
6,323,175 B1 11/2001 Hsia
7,910,607 B2 3/2011 Ba et al.
8,540,871 B2 9/2013 Zhan et al.
(Continued)

FOREIGN PATENT DOCUMENTS

EP 1321504 * 6/2003

OTHER PUBLICATIONS

P.I. Lacey et al., A Laboratory-Scale Test to Predict Intake Valve Deposits, SAE Technical Paper 972838, 1997, pp. 239-250.
(Continued)

*Primary Examiner* — Cephia D Toomer
(74) *Attorney, Agent, or Firm* — Robert A. Migliorini

(57) ABSTRACT

High temperature antioxidant additives and methods that improve a liquid fuel composition's thermal oxidative stability are disclosed. A liquid fuel composition may comprise a liquid fuel and a high temperature antioxidant additive. The high temperature antioxidant additive may comprise an indoline compound with a bicyclic ring structure, wherein the indoline compound comprises a six-membered aromatic ring and a five-membered aliphatic ring that share a carbon-carbon aromatic bond. The five-membered aliphatic ring may be heterocyclic and may comprise a nitrogen positioned in an alpha position to the six-membered aromatic ring.

24 Claims, 5 Drawing Sheets

(56) References Cited

U.S. PATENT DOCUMENTS

| | | | | |
|---|---|---|---|---|
| 2003/0110684 | A1 | 6/2003 | Henly et al. | |
| 2005/0103686 | A1* | 5/2005 | Taylor | C10G 25/05 208/254 R |
| 2007/0204505 | A1 | 9/2007 | Abou-Nemeh | |
| 2008/0028674 | A1 | 2/2008 | Jackson et al. | |
| 2009/0107555 | A1* | 4/2009 | Aradi | C10L 1/14 137/13 |
| 2010/0319243 | A1 | 12/2010 | Aradi et al. | |
| 2012/0000117 | A1 | 1/2012 | Aradi | |
| 2017/0100617 | A1 | 4/2017 | Kochelek et al. | |

OTHER PUBLICATIONS

T. Nishixzaki et al., The Effects of Fuel Composition and Fuel Additives on Intake System Detergency of Japanese Automobile Engine, SAE Technical Paper 790203, 1979, pp. 1-13.

The International Search Report and Written Opinion of PCT filing, PCT/US2019/062983, dated Feb. 2, 2020.

* cited by examiner

FUEL HIGH TEMPERATURE ANTIOXIDANT ADDITIVE

CROSS-REFERENCE TO RELATED APPLICATIONS

This application claims the priority benefit of U.S. Provisional Application No. 62/776,496 filed Dec. 7, 2018, entitled "Fuel High Temperature Antioxidant Additive", the disclosure of which is incorporated herein by reference.

FIELD

This application relates to high temperature antioxidant additives for liquid fuels, and, more particularly, embodiments relate to high temperature antioxidant additives including an indoline compound that improve a liquid fuel's thermal oxidative stability.

BACKGROUND

Operation of an internal combustion engine can lead to deposits in the fuel system. The deposits can adversely impact engine performance, potentially resulting in fuel system component malfunction or failure. For instance, the deposits can restrict the flow of air and fuel entering the combustion chamber, which can cause stalling and hesitation. One contributor to fuel system deposits is fuel oxidation, caused by reactions between molecular oxygen and the fuel. This process is accelerated with higher temperatures. To achieve better combustion and reduced emissions, modern engine designs have trended toward higher fuel system operating temperatures and pressures, thus subjecting fuels to higher thermal loads than has been typical in the past. However, the increased thermal loads can lead to increased fuel oxidation and, thus, increased deposits.

One technique that has been used for fuel-system deposit control has been to use detergents. However, detergents typically do not work across the entire fuel system and may be designed to target specific components within the fuel system, e.g., carburetor detergents, intake valve detergents, valve stem deposit fluidizers, and direct injector detergents, among others. In some instances, a detergent targeting a specific component can cause deposits in other components of the fuel system. For instance, high levels of carburetor detergents can increase piston ring belt deposits and intake valve deposits, while intake valve detergents that can clean the tops of valve tulips can create sticky valve stem deposits. Additionally, these detergents and the fluidizers that often accompany them are typically not conducive to combusting and tend to contribute to combustion chamber deposits, which are known to lead to octane rating increase, combustion chamber deposit interference, disturbance of the air-fuel mixture formation, and/or increased regulated emissions. In addition, while detergents are designed to address the deposits that can result from oxidation, they are not designed to stop oxidation from occurring. While antioxidant additives have been included in fuels, they are designed to combat oxidation and preserve fuel stability at ambient storage conditions rather than engine operating temperatures. At increased temperatures, these antioxidants can degrade and lead to fuel system deposits.

SUMMARY

Disclosed herein is an example liquid fuel composition. The example liquid fuel composition may include a liquid fuel and a high temperature antioxidant additive. The high temperature antioxidant additive may include an indoline compound with a bicyclic ring structure, wherein the indoline compound includes a six-membered aromatic ring and a five-membered aliphatic ring that share a carbon-carbon aromatic bond. The five-membered aliphatic ring may be heterocyclic and includes a nitrogen positioned in an alpha position to the six-membered aromatic ring.

Further disclosed herein is another example liquid fuel composition. The example liquid fuel composition may include a liquid fuel in an amount of about 98 vol. % or greater and a high temperature antioxidant additive. The high temperature antioxidant additive may include an indoline compound having the following structure:

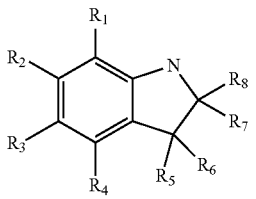

wherein $R_1$, $R_2$, $R_3$, $R_4$, $R_5$, $R_6$, $R_7$, and $R_8$ are individually selected from hydrogen, an alkyl group, an alkenyl group, a heteroatom substituted alkyl group, or a heteroatom substituted alkenyl group.

Further disclosed herein is a method for improving thermal oxidative stability of a liquid fuel at high thermal loads. An example method may include combusting in an internal combustion engine a fuel composition including the liquid fuel and an antioxidant additive. The antioxidant additive may include an indoline compound with a bicyclic ring structure. The indoline compound may include a six-membered aromatic ring and a five-membered aliphatic ring that share a carbon-carbon aromatic bond. The five-membered aliphatic ring may be heterocyclic and includes a nitrogen positioned in an alpha position to the six-membered aromatic ring.

BRIEF DESCRIPTION OF THE DRAWINGS

These drawings illustrate certain aspects of the present invention and should not be used to limit or define the invention.

DETAILED DESCRIPTION

This application relates to high temperature antioxidant additives for liquid fuels, and, more particularly, embodiments relate to high temperature antioxidant additives including an indoline compound and methods that improve a liquid fuel composition's thermal oxidative stability. As used herein, the antioxidant additives are referred to as "high temperature" antioxidant additives because the antioxidant additives improve a liquid fuel composition's thermal oxidative stability. Embodiments disclose an antioxidant additive including an indoline compound to improve the thermal oxidative stability of a liquid fuel composition. Thermal oxidative stability is measured in terms of the liquid fuel composition's tendency to form deposits in the fuel system, including fuel lines, heat exchangers and nozzles of jet engines as well as on the intake valves, ports, fuel injectors, and combustion chamber surfaces of gasoline and diesel engines. By operation improvement of the thermal oxidative stability, the antioxidant additives may not only help with fuel storage stability but also provide benefits to the liquid fuel composition at engine operating temperatures.

Figure 1:
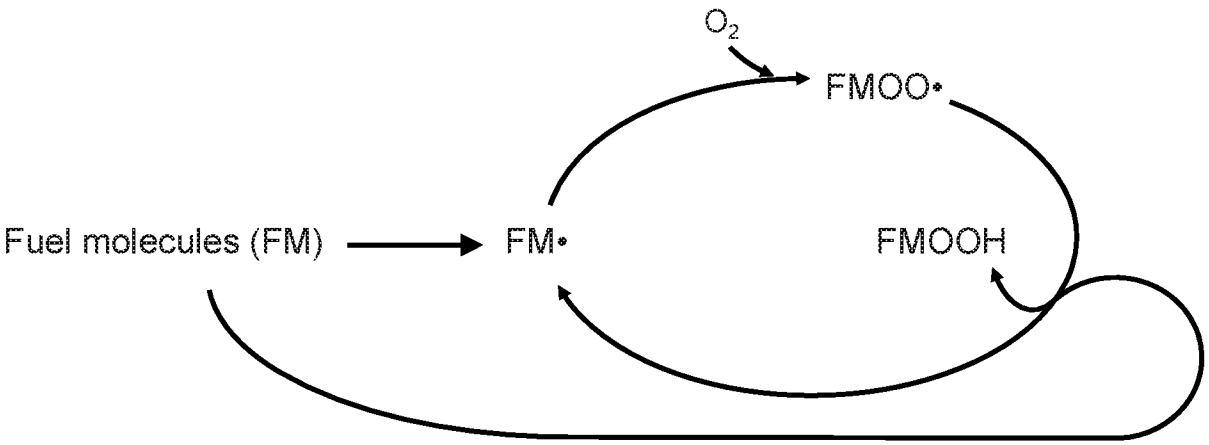
FIG. 1 illustrates an autoxidative free radical chain reaction process for a fuel oxidative degradation.

During heating of a liquid fuel composition, for example, in operation of an engine, fuel oxidative degradation proceeds through an autoxidative free radical chain reaction process. An example reaction scheme for fuel oxidative degradation is provided in FIG. 1. The fuel molecules (shown as FM) present in the liquid fuel composition break down into free radicals (shown as FM.). Propagation reactions may then occur in which the free radicals combine with oxygen to form peroxide radicals (shown as FMOO.) which abstract hydrogen from another fuel molecule, or within the same fuel molecule, to form a new FM. and a hydroperoxide. Termination reactions may then occur in which the peroxide radicals are eliminated. The termination reactions include reaction of the peroxide radicals with additional fuel molecule radicals to form peroxides. Hydroperoxides formed from the chain reaction are inherently unstable to heat and can readily decompose to yield additional free radicals (e.g., FM. and OH.), which continue to initiate additional chain reactions and additional hydroperoxides (shown as FMOOH). Hydroperoxides are a primary product of autoxidation and therefore may be considered the main initiators in thermal oxidation. Hydroperoxides, and their decomposition products are ultimately responsible for the changes in molecular structure and fuel system deposits. Conventional antioxidants produce hydroperoxides that stop the chain reaction at storage temperatures but can decompose to produce free radicals when heated. However, the high temperature antioxidant additive disclosed herein including an indoline compound should delay the oxidation induction period of the liquid fuel composition. As the oxidation induction period is delayed less peroxide radicals are generated, leading to less hydroperoxides and ultimately less deposits. In other words, the antioxidant additive may be considered to block fuel degradation pathways at high temperatures.

There may be several potential advantages to the compositions and methods disclosed herein, only some of which may be alluded to in the present disclosure. One of the many potential advantages of the compositions and methods is that the antioxidant additive should extend the oxidation induction period of the liquid fuel composition. The oxidation induction period is an initial slow stage of fuel oxidation after which the oxidation reaction accelerates. By extending the oxidation induction period, fuel oxidation in the fuel system that leads to deposits may be reduced or potentially avoided. In some embodiments, the oxidation induction period may be extended to a timeframe that is longer than the liquid fuel composition will spend at elevated temperatures in the fuel system components.

Suitable antioxidant additives may include an indoline compound. Indoline compounds have a bicyclic ring structure and include a six-membered aromatic ring and a five-membered aliphatic ring sharing a carbon-carbon aromatic bond. The aliphatic ring is heterocyclic and includes nitrogen positioned alpha (i.e., adjacent) to the aromatic ring. The aromatic ring may be heterocyclic or carbocyclic. In some embodiments, the aromatic ring and/or the aliphatic ring may be substituted. Examples substituents may include, but are not limited to, alkyl groups, alkenyl groups, heteroatom substituted alkyl groups, or heteroatom substituted alkenyl groups. Suitable heteroatoms that may be substituted may include, but are not limited to, nitrogen, oxygen, and sulfur, among others.

Examples of suitable antioxidant additives including an indoline compound may include, but are not limited to, a bicyclic ring structure of Formula (1) as follows:

(1)

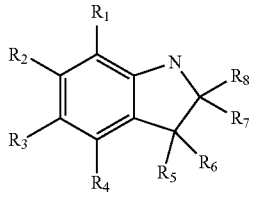

wherein $R_1$, $R_2$, $R_3$, $R_4$, $R_5$, $R_6$, $R_7$, and $R_8$ are individually selected from hydrogen, an alkyl group, an alkenyl group, a heteroatom substituted alkyl group, or a heteroatom substituted alkenyl group. Suitable heteroatoms that may be substituted may include, but are not limited to, nitrogen, oxygen, and sulfur, among others. The alkyl or alkenyl (or heteroatom substituted) groups of $R_1$, $R_2$, $R_3$, $R_4$, $R_5$, $R_6$, $R_7$, and $R_8$ may be the same or different and, in some embodiments, may include 1 carbon atom to 18 carbon atoms, or, more particularly, include 1 carbon atom to 2 carbon atoms. In some embodiments, $R_1$, $R_2$, $R_3$, $R_4$, $R_5$, $R_6$, $R_7$, and $R_8$ are each hydrogen.

Yet another example of a suitable antioxidant additives including an indoline compound may include, but are not limited to, a bicyclic ring structure of Formula (2) as follows:

(2)

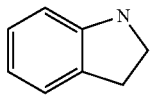

Yet another example of a suitable antioxidant additives including an indoline compound may include, but are not limited to, a bicyclic ring structure of Formula (3) as follows:

(3)

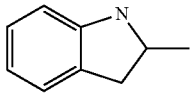

This structure may be commonly referred to as 2-methylindoline.

As previously described, the high temperature antioxidant additive including an indoline compound can be used to improve a liquid fuel composition's thermal oxidative stability. The high temperature antioxidant additive may be included in the liquid fuel composition in any suitable amount as desired for improving thermal oxidative stability. In some embodiments, the high temperature antioxidant composition can be present in the liquid fuel composition in an amount ranging from about 0.1 parts per million ("ppm") to about 500 ppm and, more particularly, ranging from about 1 ppm to about 100 ppm. In some embodiments, the high temperature antioxidant additive may be present in the liquid fuel composition in an amount of about 0.1 ppm, about 0.5 ppm, about 1 ppm, about 5 ppm, about 10 ppm, about 25 ppm, about 50 ppm, about 100 ppm, about 200 ppm, about 300 ppm, about 400 ppm, or about 500 ppm. One of ordinary skill in the art with the benefit of this disclosure should be able to select an appropriate amount of the high temperature antioxidant additive based on a number of factors, including, but not limited to, fuel system operating conditions, the particular aromatic carbocyclic ring and substituents thereon, and the liquid fuel's hydrocarbon components, among others.

In some embodiments, the high temperature antioxidant additive including an indoline compound may be included in a liquid fuel composition to extend an oxidation induction period of the liquid fuel composition, which should result in improved thermal stability. The oxidation induction period may be extended as compared to the liquid fuel composition without the high temperature antioxidant additive, for example, from about 10% to 100%, or longer than the fuel without the additive. In some embodiments, the oxidation induction period may be extended as compared to the liquid fuel composition without the high temperature antioxidant additive for period of about 200 seconds, about 500 seconds, about 1,000 seconds, about 2,000 seconds, about 5,000 seconds, about 10,000 seconds, or even longer. The oxidation induction period is an initial slow stage of fuel oxidation after which the oxidation reaction accelerates. As used herein, the oxidation induction period is determined using the PetroOXY automatic oxidation stability tester using a test method developed based on ASTM D 7245. In the test method, a 5 mL sample of the liquid fuel composition is combined with starting oxygen at a pressure of 500 kPa for motor gasoline or 700 kPa for diesel in a small, hermetically seal test chamber and heated to a test temperature. Pressure increases as the temperature of the vessel is increased from the volatilization of the light components of the fuel. Pressure is monitored over time. End of test is where a 10% drop in pressure from the maximum vessel pressure is measured. Tests temperatures are chosen that reflect relevant fuel end use temperatures in fuel systems. It has been determined that the time needed to achieve a pressure drop is directly related to induction period of the fuel composition and, thus, the thermal oxidation stability of the fuel composition. The test temperature for diesel fuel is 200° C. corresponding to a severe condition a fuel would experience in a diesel fuel injector tip. The test temperature for motor gasoline is 155° C. corresponding to a severe condition a fuel would experience in a gasoline fuel injector tip. Lower temperatures were used when the fuel composition was not able to obtain the severe conditions such as in for biodiesel testing.

In some embodiments, the high temperature antioxidant additive may be introduced into a fuel system of an internal combustion engine. In some embodiments, the high temperature antioxidant combination may be combined with the liquid fuel composition in the internal combustion engine. In some embodiments, the high temperature antioxidant composition may be introduced into the internal combustion engine as a component of the liquid fuel composition. In a combustion chamber of the internal combustion engine, the liquid fuel composition may be burned. Suitable internal combustion engines may include, but are not limited to, rotary, turbine, spark ignition, compression ignition, 2-stroke, or 4-stroke engines. In some embodiments, the internal combustion engines include marine diesel engines, aviation piston and turbine engines, aviation supersonic turbine engines, low-load diesel engines, and automobile and truck engines. In some embodiments, the internal combustion engine may comprise a direct injection engine. In some embodiments, the internal combustion engine may comprise a supersonic turbine engine. In some embodiments, the internal combustion engine may comprise a high pressure common-rail direct fuel injection engine.

In addition to the high temperature antioxidant additive, the liquid fuel composition may further include a liquid fuel. The liquid fuel may include, but are not limited to, motor gasoline, aviation gasoline, aviation turbine fuel, supersonic fuel, marine fuel, and diesel fuel. Combinations of different liquid fuels may also be used. Motor gasoline includes a complex mixture of relatively volatile hydrocarbons blended to form a fuel suitable for use in spark-ignition engines. Motor gasoline, as defined in ASTM Specification D4814, is characterized as having a boiling range of 50° C. to 70° C. at the 10-percent recovery point to 185° C. to 190° C. at the 90-percent recovery point. The diesel fuel can be a petroleum distillate as defined by ASTM specification D975. The aviation turbine fuels can be a petroleum distillate as defined by ASTM specification D1655. The aviation gasoline can be mixture of various isoctanes as defined by ASTM specification D910. The supersonic fuel can be a compound mixture composed primarily of hydrocarbons; including alkanes, cycloalkanes, alkylbenzenes, indanes/tetralins, and naphthalenes. As used herein, a supersonic fuel is a fuel that meets the specification for propellant, rocket grade kerosene (either RP-1 or RP-2) in MIL-DTL-25576, dated Apr. 14, 2006. Supersonic fuels are typically capable of standing up to higher heats (without undesirable breakdown) from air friction on the aircraft at speeds greater than the speed of sound. Fuel that breaks down can potentially clog the fuel pipes on its way to the burner. Additional examples of suitable liquid fuels may include, but are not limited to, an alcohol, an ether, a nitroalkane, an ester of a vegetable oil, or combinations thereof. In some embodiments, the nonhydrocarbon fuels may include, but are not limited to, methanol, ethanol, diethyl ether, methyl t-butyl ether, nitromethane, and methyl esters of vegetable oils such as the methyl ester of rapeseed oil. In some embodiments, the liquid fuel may include a mixture of a motor gasoline and ethanol or a mixture of a diesel fuel and a biodiesel fuel, such as an ester of a vegetable oil.

The liquid fuel may be present in the liquid fuel composition with the high temperature antioxidant additive in any suitable amount. As previously described, the liquid fuel may include any suitable liquid fuel, including a combination of two or more different fuels. In some embodiments, the liquid fuel may be present in the liquid fuel composition in an amount ranging from 98% to 99.99999% by weight of the liquid fuel composition, from 98% to 99.99999% by weight of the liquid fuel composition, or from 99% to 99.999999% by weight of the liquid fuel composition. One of ordinary skill in the art, with the benefit of this disclosure, should be able to select an appropriate liquid fuel and amount thereof to include in the liquid fuel composition for a particular application.

In some embodiments, additional additives can be included in the liquid fuel composition as desired by one of ordinary skill in the art for a particular application. Examples of these additional additives include, but are not limited to, detergents, rust inhibitors, corrosion inhibitors, lubricants, antifoaming agents, demulsifiers, conductivity improvers, metal deactivators, cold-flow improvers, cetane improvers and fluidizers, among others. One of ordinary skill in the art, with the benefit of this disclosure, should be able to select additional additives and amounts thereof as needed for a particular application.

EXAMPLES

To facilitate a better understanding of the present invention, the following examples of certain aspects of some embodiments are given. In no way should the following examples be read to limit, or define, the entire scope of the invention.

Example 1

An antioxidant additive was added to a motor gasoline in an amount of 10 ppm. The antioxidant additive was an indoline compound of Formula 2 above. The oxidation induction period was then measured for this sample liquid fuel composition using the PetroOXY automatic oxidation stability tester as described above. For comparative purposes, the oxidation induction period for the same motor gasoline was also tested without the addition of the antioxidant additive. The test temperature was 155° C. The motor gasoline used for this test was a premium gasoline blendstock for oxygenate blending ("PBOB"). The PBOB was free of ethanol.

Figure 2:
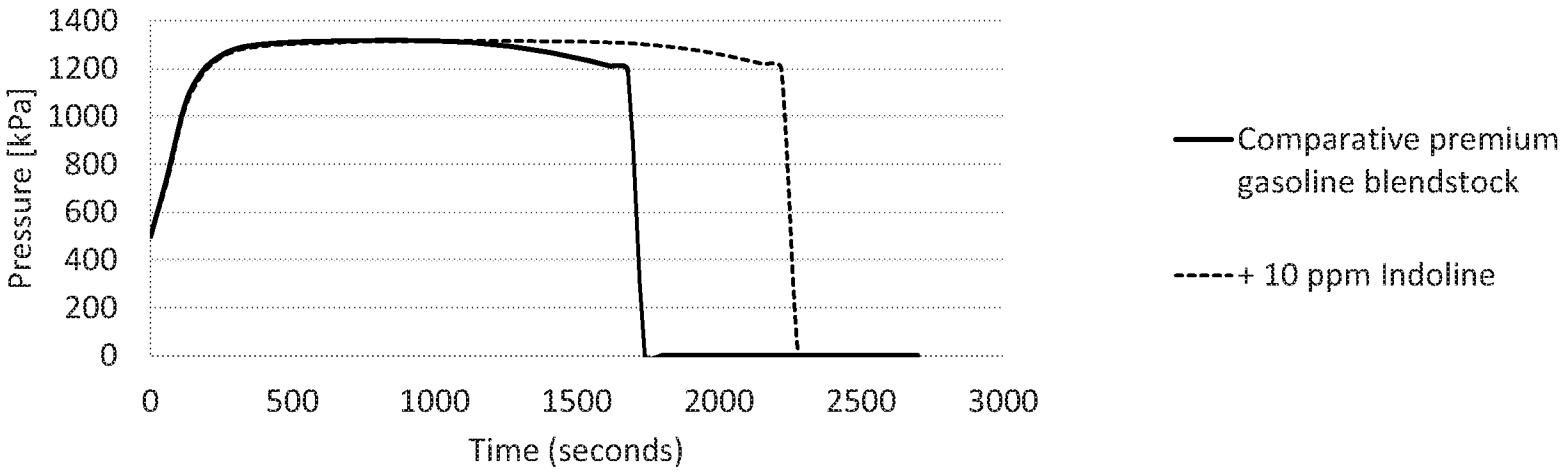
FIG. 2 is a chart showing the oxidation induction period for a premium motor gasoline blendstock with 10 ppm of an antioxidant additive including an indoline compound and the oxidation induction period for a comparative sample without the antioxidant additive.

FIG. 2 is a chart showing the oxidation induction period for these tests. As illustrated, the addition of 10 ppm of the antioxidant additive extended the oxidation induction period for the PBOB by more than 500 seconds. Indeed, the addition of the antioxidant additive extended the oxidation induction period by approximately 36%. The point where there is a precipitous drop in the trace highlights the end of tests and the time where the pressure drop=10% from its maximum value. Extending this point to zero pressure in the trace helps delineate the end point in the data where the no further data was collected and the heating to the sample was discontinued.

Example 2

To further evaluate an antioxidants additive's impact on a liquid fuel's thermal stability, additional testing was performed by adding the antioxidant additive to another motor gasoline in the amount of 10 ppm. The antioxidant additive was an indoline compound of Formula 2 above. The oxidation induction period was then measured for this sample liquid fuel composition using the PetroOXY automatic oxidation stability tester as described above. For comparative purposes, the oxidation induction period for the same motor gasoline was also tested without the addition of the antioxidant additive. The test temperature was 155° C. The motor gasoline used for this test was a regular gasoline blendstock for oxygenate blending ("RBOB"). The PBOB was free of ethanol.

Figure 3:
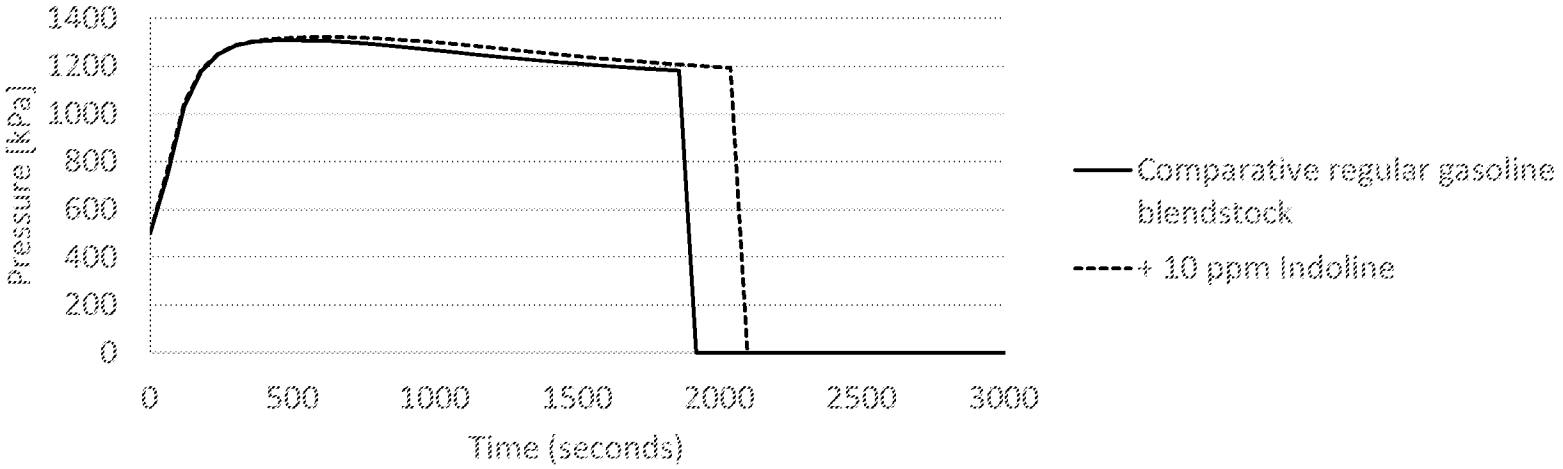
FIG. 3 is a chart showing the oxidation induction period for a regular motor gasoline blendstock with 10 ppm of an antioxidant additive including an indoline compound and the oxidation induction period for a comparative sample without the antioxidant additive.

FIG. 3 is a chart showing the oxidation induction period for these tests. As illustrated, the addition of 10 ppm of the antioxidant additive extended the oxidation induction period for the RBOB by more than 150 seconds. Indeed, the addition of the antioxidant additive extended the oxidation induction period by approximately 10%.

Example 3

An antioxidant additive was added to a motor gasoline in an amount of 10 ppm. The antioxidant additive was a 2-methylindoline compound of Formula 3 above. The oxidation induction period was then measured for this sample liquid fuel composition using the PetroOXY automatic oxidation stability tester as described above. For comparative purposes, the oxidation induction period for the same motor gasoline was also tested without the addition of the antioxidant additive. The test temperature was 155° C. The motor gasoline used for this test was a premium gasoline blendstock for oxygenate blending ("PBOB"). The PBOB was free of ethanol.

Figure 4:
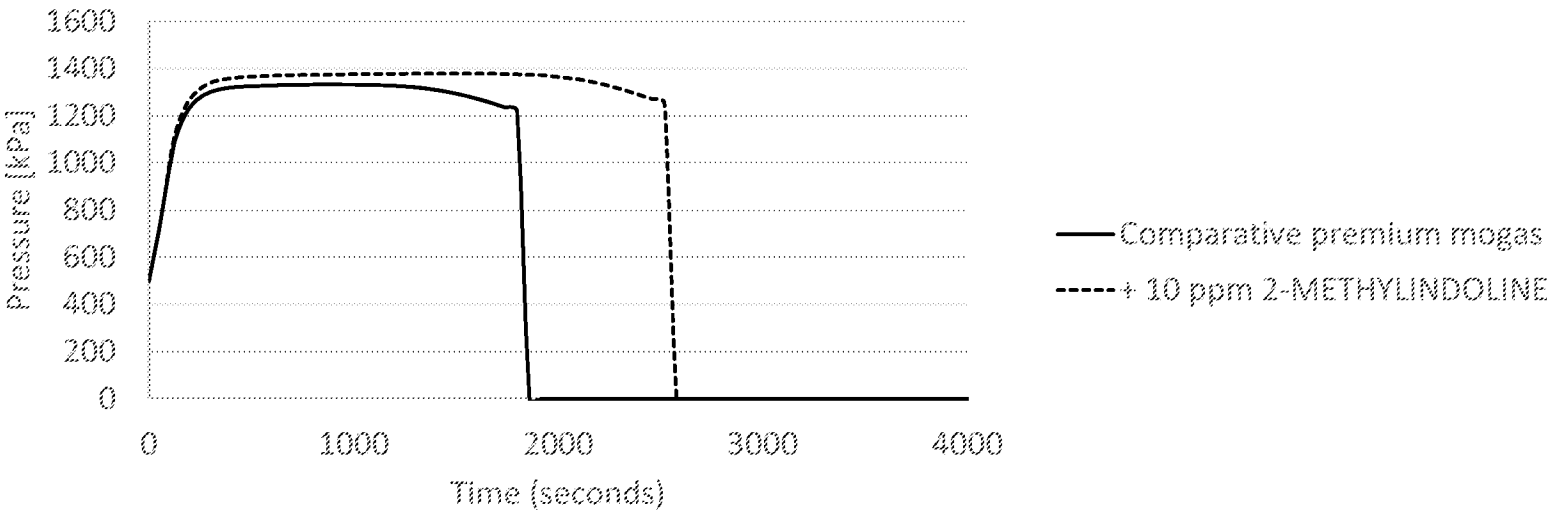
FIG. 4 is a chart showing the oxidation induction period for a premium motor gasoline blendstock with 10 ppm of an antioxidant additive including an 2-methylindoline compound and the oxidation induction period for a comparative sample without the antioxidant additive.

FIG. 4 is a chart showing the oxidation induction period for these tests. As illustrated, the addition of 10 ppm of the antioxidant additive extended the oxidation induction period for the PBOB by more than 500 seconds. Indeed, the addition of the antioxidant additive extended the oxidation induction period by approximately 35%.

Example 4

Additional testing was performed to evaluate the antioxidant additive in modern gasoline engine direct injectors. The testing used a custom benchtop heating assembly that included an aluminum heating block with multiple gasoline direct injectors mounted inside as set forth in the table below:

TABLE 1

| Position | Injector Type |
|---|---|
| 1 | Engine OEM A- Injector Manufacturer A |
| 2 | Engine OEM B- Injector Manufacturer A |
| 3 | Engine OEM A- Injector Manufacturer B |
| 4 | Engine OEM C- Injector Manufacturer C |
| 5 | Engine OEM D- Injector Manufacturer C |
| 6 | Engine OEM B- Injector Manufacturer D |
| 7 | Engine OEM A- Injector Manufacturer A |

The injectors were flow tested before and after a thermal stressing cycle. During heat ageing for 30 hours, the aluminum heating block was maintained at a set temperature (170° C. at 100 bar) while the injectors alternated between a brief discharge (15 seconds) and long heat soak periods (30 minutes). The sample fuel composition used in the testing included 10 ppm of an antioxidant additive in a motor gasoline. The antioxidant additive was an indoline compound of Formula 2 above. For comparative purposes, the same motor gasoline was also tested without the addition of the antioxidant additive.

Figure 5:
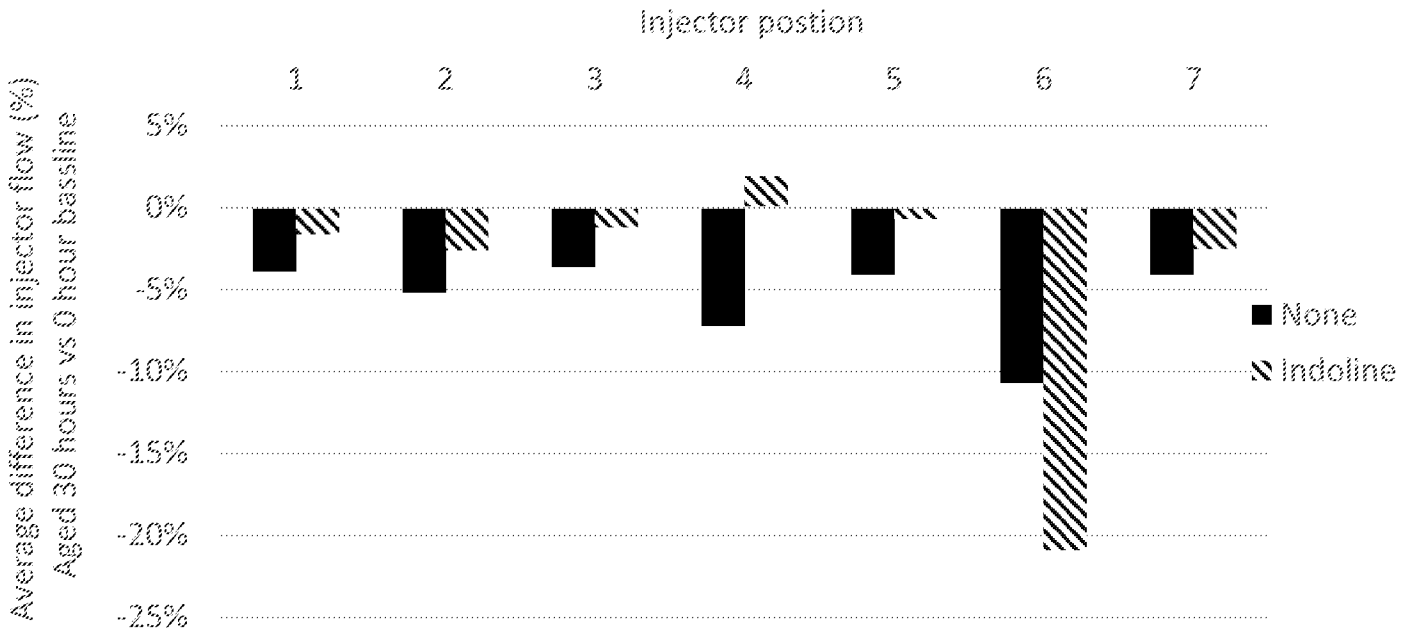
FIG. 5 is a chart showing average difference in injector flow rate for various gasoline fuel injectors tested with 10 ppm of an antioxidant additive including an indoline compound and a comparative sample without the antioxidant additive.

FIG. 5 is a chart showing the results of the testing. As illustrated, the inclusion of the antioxidant additive including an indoline compound improved fuel flow at estimated operating temperatures for all six out of seven gasoline direct injectors. It should be noted that the injector at position #6 regularly gives varied results, presumably due to its longer length which leads to interference of the fuel release at the nozzle tip.

As illustrated, the addition of the antioxidant additive reduced the amount of deposits on the valves as compared to the same fuel without the addition of the antioxidant additive. This result was improved with an increase in the concentration of the antioxidant additive.

While the invention has been described with respect to a number of embodiments and examples, those skilled in the art, having benefit of this disclosure, will appreciate that other embodiments can be devised which do not depart from the scope and spirit of the invention as disclosed herein. Although individual embodiments are discussed, the invention covers all combinations of all those embodiments.

While compositions, methods, and processes are described herein in terms of "comprising," "containing," "having," or "including" various components or steps, the compositions and methods can also "consist essentially of" or "consist of" the various components and steps. The phrases, unless otherwise specified, "consists essentially of" and "consisting essentially of" do not exclude the presence of other steps, elements, or materials, whether or not, specifically mentioned in this specification, so long as such steps, elements, or materials, do not affect the basic and novel characteristics of the invention, additionally, they do not exclude impurities and variances normally associated with the elements and materials used.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited.

The invention claimed is:

1. A liquid fuel composition comprising:

a liquid fuel; and a high temperature antioxidant additive present in an amount ranging from about 0.1 ppm to about 300 ppm comprising an indoline compound with a bicyclic ring structure, wherein the indoline compound comprises a six-membered aromatic ring and a five-membered aliphatic ring that share a carbon-carbon aromatic bond, wherein the five-membered aliphatic ring is heterocyclic and comprises a nitrogen positioned in an alpha position to the six-membered aromatic ring; and wherein the liquid fuel composition provides an extended oxidation induction period of greater than or equal to about 10% as measured by ASTM D7245 compared to the liquid fuel composition without the high temperature antioxidant additive.

2. The liquid fuel composition of claim 1, wherein the liquid fuel comprises at least one hydrocarbon fuel selected from the group consisting of a motor gasoline, an aviation gasoline, an aviation turbine fuel, a supersonic fuel, a marine fuel, a diesel fuel, and combinations thereof.

3. The liquid fuel composition of claim 1, wherein the liquid fuel comprises a mixture of a motor gasoline and ethanol.

4. The liquid fuel composition of claim 1, wherein the liquid fuel comprise a supersonic fuel, wherein the supersonic fuel comprises a mixture of alkanes, cycloalkanes, alkylbenzenes, tetralins, and naphthalenes.

5. The liquid fuel composition of claim 1, wherein the liquid fuel is present in an amount of about 98 vol.% or greater.

6. The liquid fuel composition of claim 1, wherein the six-membered aromatic ring is carbocyclic.

7. The liquid fuel composition of claim 1, wherein six-membered aromatic ring and/or the five-membered aliphatic ring are substituted with at least one substituent selected from the group consisting of an alkyl group, an alkenyl group, a heteroatom substituted alkyl group, and a heteroatom substituted alkenyl group.

8. The liquid fuel composition of claim 1, wherein the indoline compound has the following structure:

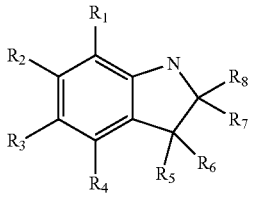

wherein $R_1$, $R_2$, $R_3$, $R_4$, $R_5$, $R_6$, $R_7$, and $R_8$ are individually selected from hydrogen, an alkyl group, an alkenyl group, a heteroatom substituted alkyl group, or a heteroatom substituted alkenyl group.

9. The liquid fuel composition of claim 8, wherein at least one of $R_1$, $R_2$, $R_3$, $R_4$, $R_5$, $R_6$, $R_7$, and $R_8$ are hydrogen.

10. The liquid fuel composition of claim 8, wherein at least one of at least one of $R_1$, $R_2$, $R_3$, $R_4$, $R_5$, $R_6$, $R_7$, or $R_8$ comprises an alkyl or alkenyl group having a length of 1 carbon atom to 18 carbon atoms.

11. The liquid fuel composition of claim 1, wherein the indoline compound has the following structure:

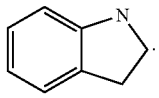

12. The liquid fuel composition of claim 1, wherein the indoline compound has the following structure:

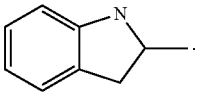

13. The liquid fuel composition of claim 1, wherein the high temperature antioxidant additive is present in an amount ranging from about 1 ppm to about 200 ppm.

14. The liquid fuel composition of claim 1, wherein the liquid fuel is present in an amount of about 99 vol. % or greater, and wherein the high temperature antioxidant additive is present in an amount ranging from about 1 ppm to about 100 ppm.

15. The liquid fuel composition of claim 1, further comprising at least one additional additive selected from the group consisting of a detergent, a rust inhibitor, a corrosion inhibitor, a lubricant, an antifoaming agent, a demulsifier, a conductivity improver, a metal deactivator, a cold-flow improver, a cetane improvers, fluidizer, and combinations thereof.

16. A liquid fuel composition comprising:

a liquid fuel in an amount of about 98 vol. % or greater; and a high temperature antioxidant additive present in an amount ranging from about 0.1 ppm to about 300 ppm comprising an indoline compound having the following structure:

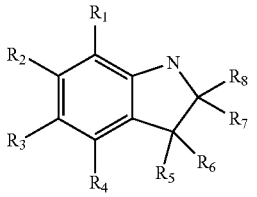

wherein $R_1$, $R_2$, $R_3$, $R_4$, $R_5$, $R_6$, $R_7$, and $R_8$ are individually selected from hydrogen, an alkyl group, an alkenyl group, a heteroatom substituted alkyl group, or a heteroatom substituted alkenyl group; and wherein the liquid fuel composition provides an extended oxidation induction period of greater than or equal to about 10% as measured by ASTM D7245 compared to the liquid fuel composition without the high temperature antioxidant additive.

17. The liquid fuel composition of claim 16, wherein the liquid fuel comprises at least one hydrocarbon fuel selected from the group consisting of a motor gasoline, an aviation gasoline, a marine fuel, a diesel fuel, and combinations thereof.

18. The liquid fuel composition of claim 16, wherein $R_1$, $R_2$, $R_3$, $R_4$, $R_5$, $R_6$, $R_7$, and $R_8$ are each hydrogen.

19. A method for improving thermal oxidative stability of a liquid fuel at high thermal loads, comprising:

combusting in an internal combustion engine a fuel composition comprising the liquid fuel and an antioxidant additive, wherein the antioxidant additive is present in an amount ranging from about 0.1 ppm to about 300 ppm comprises an indoline compound with a bicyclic ring structure, wherein the indoline compound comprises a six-membered aromatic ring and a five-membered aliphatic ring that share a carbon-carbon aromatic bond, wherein the five-membered aliphatic ring is heterocyclic and comprises a nitrogen positioned in an alpha position to the six-membered aromatic ring: and wherein the fuel composition provides an extended oxidation induction period of greater than or equal to about 10% as measured by ASTM D7245 compared to the fuel composition without the antioxidant additive.

20. The method of claim 19, wherein the liquid fuel comprises at least one hydrocarbon fuel selected from the group consisting of a motor gasoline, an aviation gasoline, diesel fuel, and combinations thereof.

21. The method of claim 19, wherein $R_1$, $R_2$, $R_3$, $R_4$, $R_5$, $R_6$, $R_7$, and $R_8$ are each hydrogen.

22. The method of claim 19, wherein the internal combustion engine is a direct injection engine.

23. The method of claim 19, wherein the internal combustion engine is a supersonic turbine engine.

24. The method of claim 19, wherein the internal combustion engine is a common-rail direct fuel injection engine.

* * * * *